US009392681B2

(12) United States Patent
Botto

(10) Patent No.: US 9,392,681 B2
(45) **Date of Patent: *Jul. 12, 2016**

(54) BOREHOLE POWER AMPLIFIER

(75) Inventor: Tancredi Botto, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 478 days.

This patent is subject to a terminal disclaimer.

(21) Appl. No.: 13/566,539

(22) Filed: Aug. 3, 2012

(65) Prior Publication Data

US 2014/0037065 A1 Feb. 6, 2014

(51) Int. Cl.

| | |
|---|---|
| ***H05G 1/08*** | (2006.01) |
| ***H05H 9/00*** | (2006.01) |
| ***H01J 35/14*** | (2006.01) |
| ***H05G 1/00*** | (2006.01) |
| ***H05G 1/10*** | (2006.01) |

(52) U.S. Cl.

CPC ..... *H05H 9/005* (2013.01); *H01J 35/14* (2013.01); *H05G 1/00* (2013.01); *H05G 1/10* (2013.01)

(58) Field of Classification Search

CPC ..... H01H 9/00; H05H 7/001; H05H 7/04; H05H 15/00; G01V 3/30; H05G 1/10; H01J 35/00

USPC ..... 378/119, 121

See application file for complete search history.

(56) References Cited

U.S. PATENT DOCUMENTS

| | | | | |
|---|---|---|---|---|
| 3,976,879 | A | 8/1976 | Turcotte | |
| 4,093,854 | A | 6/1978 | Turcotte et al. | |
| 4,713,581 | A * | 12/1987 | Haimson | 315/5.41 |
| 5,089,785 | A | 2/1992 | Hand | |
| 5,317,234 | A | 5/1994 | Chojnacki | |
| 5,326,970 | A * | 7/1994 | Bayless | 250/269.1 |
| H1692 | H | 11/1997 | Lohrman | |
| 6,384,540 | B1 | 5/2002 | Porter, Jr. et al. | |
| 6,649,906 | B2 | 11/2003 | Adolph et al. | |
| 7,208,889 | B2 | 4/2007 | Zavadtsev et al. | |
| 7,741,934 | B2 | 6/2010 | Gorrell et al. | |
| 2006/0226443 | A1 * | 10/2006 | Ryu et al. | 257/192 |
| 2007/0018210 | A1 | 1/2007 | Sheppard | |
| 2011/0044418 | A1 | 2/2011 | Stubbers et al. | |
| 2014/0035588 | A1 * | 2/2014 | Botto | 324/333 |

OTHER PUBLICATIONS

Getta, et al., "Modular High Power Solid State RF Amplifiers for Particle Accelerators", Proceedings of PAC09, Vancouver, BC, Canada—Radio Frequency Systems, 2009, pp. 1-3.

(Continued)

*Primary Examiner* — Courtney Thomas

(57) ABSTRACT

Borehole tools and methods for analyzing earth formations are disclosed herein. An example borehole tool disclosed herein includes an RF particle accelerator. The particle accelerator includes an accelerator waveguide for accelerating electrons. The borehole tool also includes a power amplification circuit that is based on a wide bandgap semiconductor material, such as a combination of gallium nitride (GaN) and aluminum gallium nitride (AlGaN). The power amplification circuit amplifies an initial input RF signal and provides a driving RF output signal to drive acceleration of the electrons within the accelerator waveguide.

20 Claims, 8 Drawing Sheets

(56) References Cited

OTHER PUBLICATIONS

Heid, et al., "Solid State RF Power the Route to 1W Per Euro Cent", Proceedings of PAC11, New York, NY, USA—Accelerator Technology, 2011, pp. 1-3.

Horan, et al., "352-MHZ Solid-State RF Power System Development at the Advanced Photon Source", Proceedings of PAC09, Vancouver, BC, Canada—Radio Frequency Systems, 2009, pp. 1-3.

Jain, et al., "Modular 20 kW solid state RF amplifier for Indus-2 syncrotron radiation source", Nuclear Instruments and Methods in Physics Research A 676, 2012, pp. 74-83.

Marchand, et al., "High power 352 MHz solid state amplifiers developed at the Synchrotron SOLEIL", Physical Review Special Topics—Accelerators and Beams, vol. 10, 2007, p. 112001-1 to 112001-7.

U.S. Appl. No. 13/566,555, filed Aug. 3, 2012: 21 pages.

* cited by examiner

BOREHOLE POWER AMPLIFIER

RELATED APPLICATIONS

This application is related to U.S. patent application Ser. No. 13/566,539, entitled "BOREHOLE POWER AMPLIFIER" filed Aug. 3, 2012, which is published as U.S. Patent Application Publication 2014/0037065 and is incorporated herein by reference in its entirety.

TECHNICAL FIELD

This disclosure relates to power amplifiers, and more particularly to power amplifiers for particle accelerators.

BACKGROUND

X-rays are used in oil and gas field tools for a variety of different applications. In one example, X-rays are used to evaluate a substance, such as a fluid or a formation. To this end, an X-ray generator is used to generate X-rays that pass through the substance. At least some of the X-rays that pass through the substance are measured by an X-ray detector. The resulting signals from the X-ray detector can be used to determine substance characteristics, such as density, porosity and/or photo-electric effect.

X-rays with energies over 100 keV can be generated using a variety of methods. In one method, X-rays are generated by accelerating electrons within a particle accelerator and striking the electrons against a target. In above-ground systems, conventional RF amplification devices are commonly used to drive acceleration of the charged particles within the particle accelerator. Examples of such conventional RF amplification devices include klystron tubes, travelling wave tubes, magnetrons, gyrotrons and other vacuum power devices.

Such conventional RF amplification devices do not perform reliably in high temperatures and dynamic temperatures environments. High temperatures and dynamic temperatures are common in borehole environments (e.g., 175° C. and above). Accordingly, the conventional RF amplification devices are not sufficiently reliable for use in oil and gas field tools. Also, many such conventional RF amplification devices occupy a large amount of space. Large spacing requirements are particularly disadvantageous in borehole tools where available space is scarce.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Illustrative embodiments of the present disclosure are directed to a borehole tool for analyzing an earth formation. The borehole tool includes an RF particle accelerator. The particle accelerator includes an accelerator waveguide for accelerating electrons. In some embodiments, the particle accelerator includes more than one accelerator waveguide. The borehole tool also includes a power amplification circuit that is based on a wide bandgap semiconductor material, such as a combination of gallium nitride (GaN) and aluminum gallium nitride (AlGaN). The power amplification circuit amplifies an initial input RF signal and provides a driving RF output signal to drive acceleration of the electrons within the accelerator waveguide.

In various embodiments, the power amplification circuit includes a number of power amplifiers. In an illustrative embodiment, the power amplification circuit includes at least one stage of power dividers that divide the initial RF input signal and output the initial RF input to each power amplifier. The power amplification circuit also includes at least one stage of power combiners to generate the driving RF output signal by combining the amplified output signal of each power amplifier.

Illustrative embodiments of the present disclosure are directed to a method for analyzing an earth formation using a borehole tool. The method includes positioning the borehole tool within a borehole traversing the earth formation. An initial input RF signal is amplified to provide a driving RF output signal. The initial input RF signal is amplified using a power amplification circuit based on a wide bandgap semiconductor material. The driving RF output signal is used to drive acceleration of electrons within an RF particle accelerator. The electrons are accelerated toward a target to generate X-ray radiation that enters the earth formation.

Illustrative embodiments of the present disclosure are directed a borehole X-ray generator. The X-ray generator includes a source for generating electrons, a target for generating X-rays, and a RF particle accelerator. The particle accelerator includes an accelerator waveguide for accelerating electrons. The power amplification circuit amplifies an initial input RF signal and provides a driving RF output signal to drive acceleration of the electrons within the accelerator waveguide of the particle accelerator. The power amplification circuit is based on a wide bandgap semiconductor material, such as a combination of gallium nitride (GaN) and aluminum gallium nitride (AlGaN).

BRIEF DESCRIPTION OF THE DRAWINGS

Those skilled in the art should more fully appreciate advantages of various embodiments of the disclosure from the following "Description of Illustrative Embodiments," discussed with reference to the drawings summarized immediately below.

DESCRIPTION OF ILLUSTRATIVE EMBODIMENTS

Illustrative embodiments of the present disclosure are directed to a borehole power amplifier for driving acceleration of electrons within a particle accelerator. Various embodiments of the present disclosure use an RF particle accelerator for accelerating electrons. A power amplification circuit amplifies an initial input RF signal and provides a driving RF output signal to drive acceleration of the electrons within the particle accelerator. The power amplification circuit is based on a wide bandgap semiconductor material, such as a combination of gallium nitride (GaN) and aluminum gallium nitride (AlGaN). In this manner, various embodiments of the present disclosure consume less space and function more reliably in high temperature environments than conventional RF amplification devices. Details of various embodiments are discussed below.

Figure 1:
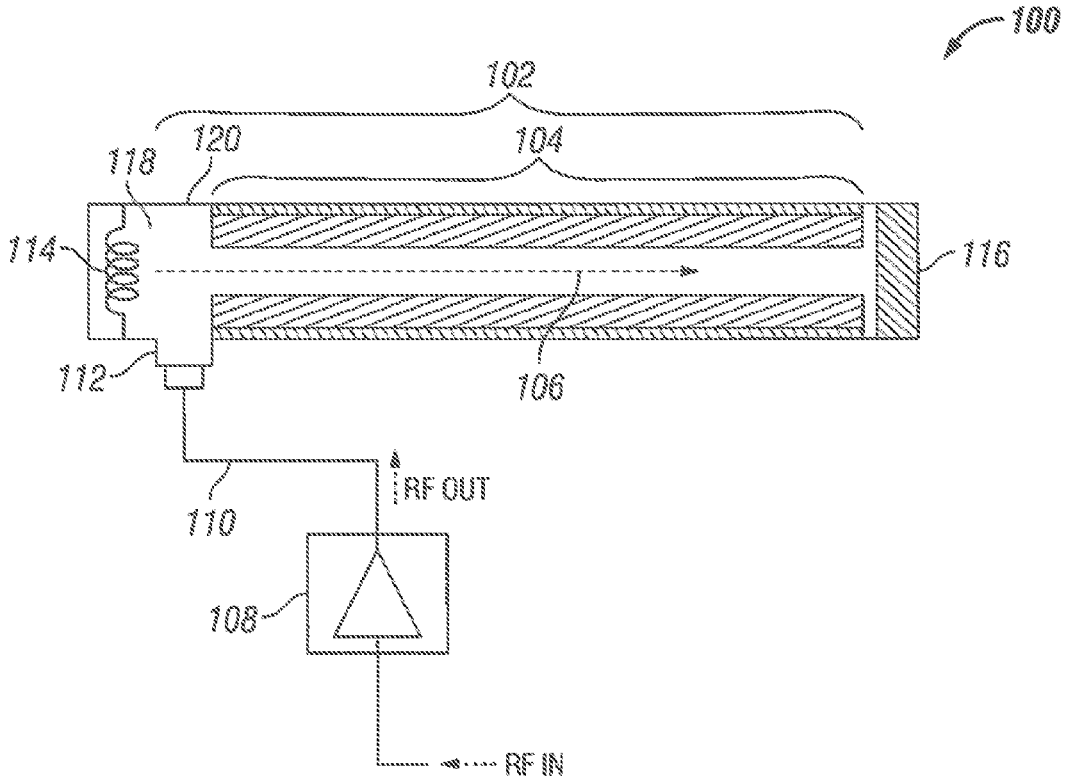
FIG. 1 shows an X-ray generator in accordance with one embodiment of the present disclosure.

FIG. 1 shows an X-ray generator 100 in accordance with one embodiment of the present disclosure. The X-ray generator 100 includes a radio frequency (RF) particle accelerator 102 for accelerating electrons. In the embodiment shown in FIG. 1, the RF particle accelerator 102 includes a single accelerator waveguide 104 for accelerating a plurality of electrons (e.g., an electron beam). Electrons are accelerated within the accelerator waveguide 104 in the direction of arrow 106. An accelerator waveguide is a device (e.g., cylindrical tube) that is designed to at least partially confine an RF field and to transfer energy between the RF field and an electron beam. The RF field oscillates at a frequency determined by the geometry and materials of the accelerator waveguide. The velocity of the electron beam changes as the beam travels through the accelerator waveguide. In this manner, the electron beam approaches relativistic speeds (e.g., sub-relativistic speeds). In one embodiment, the accelerator waveguide is configured to operate in a traveling wave mode. In additional or alternative embodiments, the accelerator waveguide is configured to operate in a standing wave mode. In illustrative embodiments, the accelerator waveguide is (1) a metal waveguide with an inner dielectric lining or coating or (2) an iris-loaded waveguide that includes multiple pill-box cavities.

Figure 2:
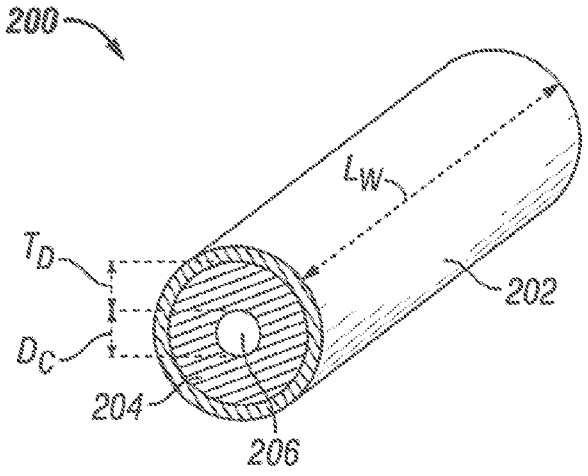
FIG. 2 shows an accelerator waveguide in accordance with one embodiment of the present disclosure.

FIG. 2 shows an accelerator waveguide 200 in accordance with one embodiment of the present disclosure. The accelerator waveguide 200 shown in FIG. 2 is a dielectric lined accelerator (DLA). The accelerator waveguide 200 includes an elongated cylinder 202 that is made from a conductive material, such as copper or aluminum. In various embodiments, the elongated cylinder has a thickness of at least 1 μm. The elongated cylinder is configured to confine electromagnetic fields within the accelerator waveguide. The interior of the elongated cylinder 202 is lined (or coated) with a durable dielectric material 204. In some embodiments, the dielectric material 204 is a glass, such as quartz. In various other embodiments, the dielectric material 204 is a ceramic, such as aluminum oxide. The dielectric material 204 may also include other oxide or non-oxide ceramics consisting of a crystalline or poly-crystalline material. Examples of crystalline materials include sapphire, rutile and other known optical crystals. The dielectric constant (e.g., $\in$) of the dielectric material can vary between 4 and 40. In various embodiments, a thickness ($T_D$) of the dielectric material 204 can range between 0.1 mm to 10 mm. The inner volume of the accelerator waveguide 200 forms a dielectric loaded cavity 206 defined by the dielectric material 204 and an outer wall of the elongated cylinder 202. The cavity 206 allows for electrons to pass through the accelerator waveguide 200, as shown in, for example, FIG. 1 (e.g., arrow 106). To this end, in various embodiments, the cavity is in an evacuated or low pressure state (e.g., a vacuum exists in the cavity). In various embodiments, the cavity 206 supports electro-magnetic modes with a reduced or varying phase velocity. The accelerator waveguide 200 is optimized for sub-relativistic electrons that pass through the accelerator waveguide. In illustrative embodiments, the cavity 206 has a diameter ($D_C$) in a range between 1 mm and 10 mm. Furthermore, a length ($L_W$) of the particle waveguide 200 can range between 2 cm and 40 cm. In some embodiments, the total diameter of the particle waveguide 200 can range between 0.5 cm and 6 cm. This small diameter facilitates the use of the accelerator waveguide 200 within borehole tools, where available space is scarce.

In various embodiments, the particle accelerator 102 uses a single dielectric lined waveguide that operates with a single electromagnetic mode. Such an arrangement is easier to operate and keep tuned than a more conventional arrangement of multiple cavities (such as with a multi-cell LINAC). Also, such an arrangement can be better optimized for sub-relativistic electron beams (e.g., less than 1 MeV), which have a varying particle velocity during acceleration. In particular, in some embodiments, the dielectric lined accelerator operates efficiently at high frequencies (e.g., at least 2.856 GHz), which further enables miniaturization of the accelerator waveguide.

The particle waveguide 200 within FIG. 2 has a circular cross section. Various embodiments of the accelerator waveguide 200 are not limited to circular cross sections. In additional or alternative embodiments, the accelerator waveguide 200 may have a square or rectangular cross section.

Various embodiments of the present disclosure are not limited to dielectric lined waveguides. In additional or alternative embodiments, photonic waveguides and multilayer waveguides can also be used.

As shown in FIG. 1, the X-ray generator 100 also includes a power amplification circuit 108. The power amplification circuit 108 amplifies an initial input RF signal. The power amplification circuit then provides a driving RF output signal to drive acceleration of the electrons within the accelerator waveguide 104 of the particle accelerator 102. The power amplification circuit 108 is used as a primary power source that drives the acceleration of the electrons within the particle accelerator 102, as opposed to other solid-state amplifiers, which are used merely to maintain orbit of electrons within circular particle accelerators. Amplifiers based on silicon LDMOS technology have been used to maintain orbit of electrons within circular particle accelerators.

At least a portion of the power amplification circuit 108 is based on a wide bandgap semiconductor material. In particular embodiments, power amplifiers within the power amplification circuit 108 are fabricated so that electrons within the power amplifiers flow through low-resistivity pathways that are formed from at least one wide band gap semiconductor material. In a specific embodiment, the low-resistivity pathway is created at an interface of two wide bandgap semiconductor materials. To this end, in various embodiments, the wide bandgap semiconductor material includes a combination of materials. For example, the wide bandgap semiconductor material includes a combination of nitride materials, such as a combination of gallium nitride (GaN) and aluminum gallium nitride (AlGaN). In various additional or alternative embodiments, the wide bandgap semiconductor material can include any one of aluminum nitride (AlN), boron nitride (BN), gallium oxide ($Ga_2O_3$), diamond, silicon carbide (SiC), or combinations of such compounds. Also, the wide bandgap semiconductor material can include combinations of group III-V elements.

Figure 3:
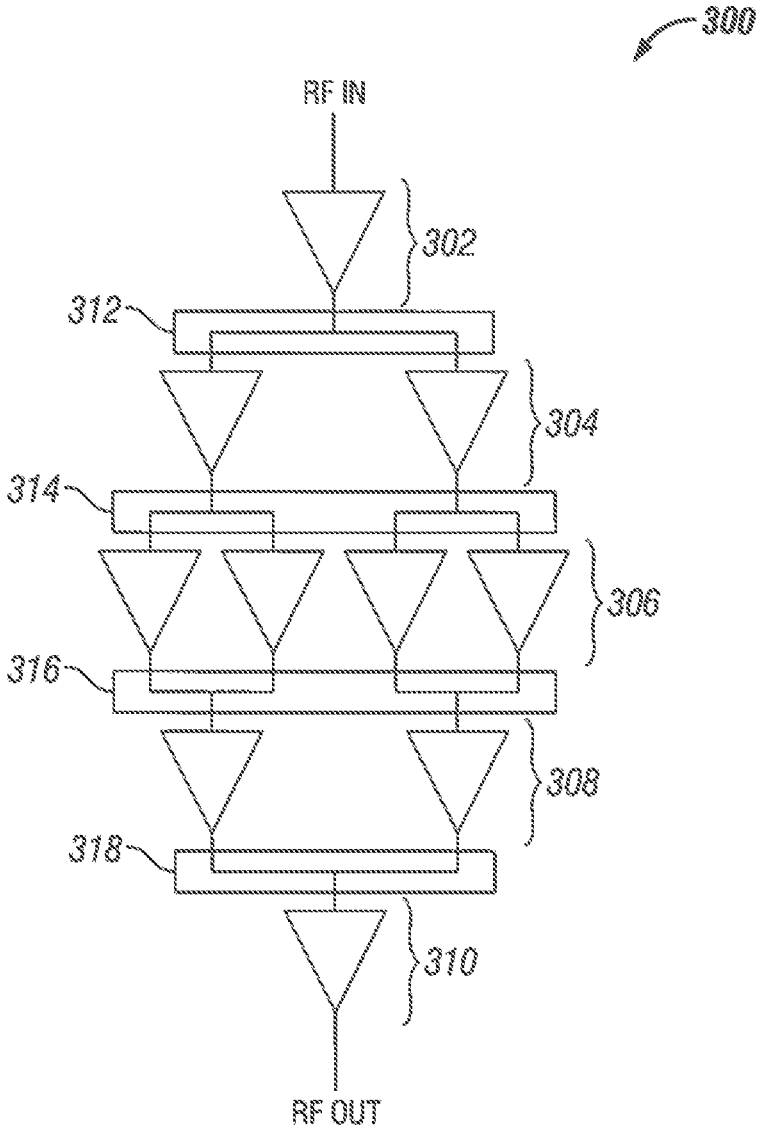
FIG. 3 shows a power amplification circuit in accordance with one embodiment of the present disclosure.

In various embodiments of the present disclosure, the power amplification circuit is composed of a plurality of power amplifiers that are based on a wide bandgap semiconductor material. Each power amplifier is configured to amplify an input signal and output an amplified output signal. FIG. 3 shows a power amplification circuit 300 in accordance with one embodiment of the present disclosure. In this embodiment, the amplification circuit 300 includes five amplifier stages (302, 304, 306, 308, 310), two splitter stages (312, 314), and two summing stages (316, 318). The splitter stages include power dividers, or power splitters, that split the RF signal into multiple RF signal components. Also, the summing stages include power combiners for combing multiple RF signal components.

In this embodiment, an input RF signal is provided to a first amplifier stage 302. The input RF signal is amplified within the first amplifier stage 302 and provided as an amplified RF output signal to the first splitter stage 312. The first splitter stage 312 splits the amplified RF output signal into two similar RF signal components. The RF signal components enter the second amplifier stage 304 as input RF signals. The second amplifier stage 304 includes two amplifiers that amplify the components and provide the components to the second splitter stage 314. The second splitter stage 314 splits the two amplified components into four similar RF signal components, which are output to the third amplifier stage 306. The third amplifier stage 306 includes four amplifiers, which each respectively amplifies the four RF signal components. The four RF signal components then enter the first summing stage 316. The first summing stage 316 combines the four RF signal components and outputs two RF signal components, which enter the fourth amplifier stage 308. The two RF signal components are again amplified within the fourth amplifier stage 308 and are combined within the second summing stage 318. The single RF signal is then amplified in the fifth amplifier stage 310. This amplified single RF signal is used as a driving RF output signal to drive acceleration of the electrons within the particle accelerator 102. In this manner, the power amplification circuit 108 receives a low power input RF signal and amplifies that signal to provide a high power driving RF signal to the particle accelerator.

Various embodiments of the power amplification circuit can include a number of different amplifier stages (e.g., 1, 2, 5, 10, 20), splitter stages (e.g., 1, 2, 5, 10, 20), and summing stages (e.g., 1, 2, 5, 10, 20). Also, various embodiments of the power amplification circuit can include a number of different total amplifiers (e.g., 10, 100, 1000). In various embodiments, the power amplification circuit is monolithic. In one particular embodiment, the power amplification circuit is a monolithic microwave integrated circuit (MMIC). Such MMIC circuits facilitate cascading of amplifiers in a compact fashion.

Figure 4:
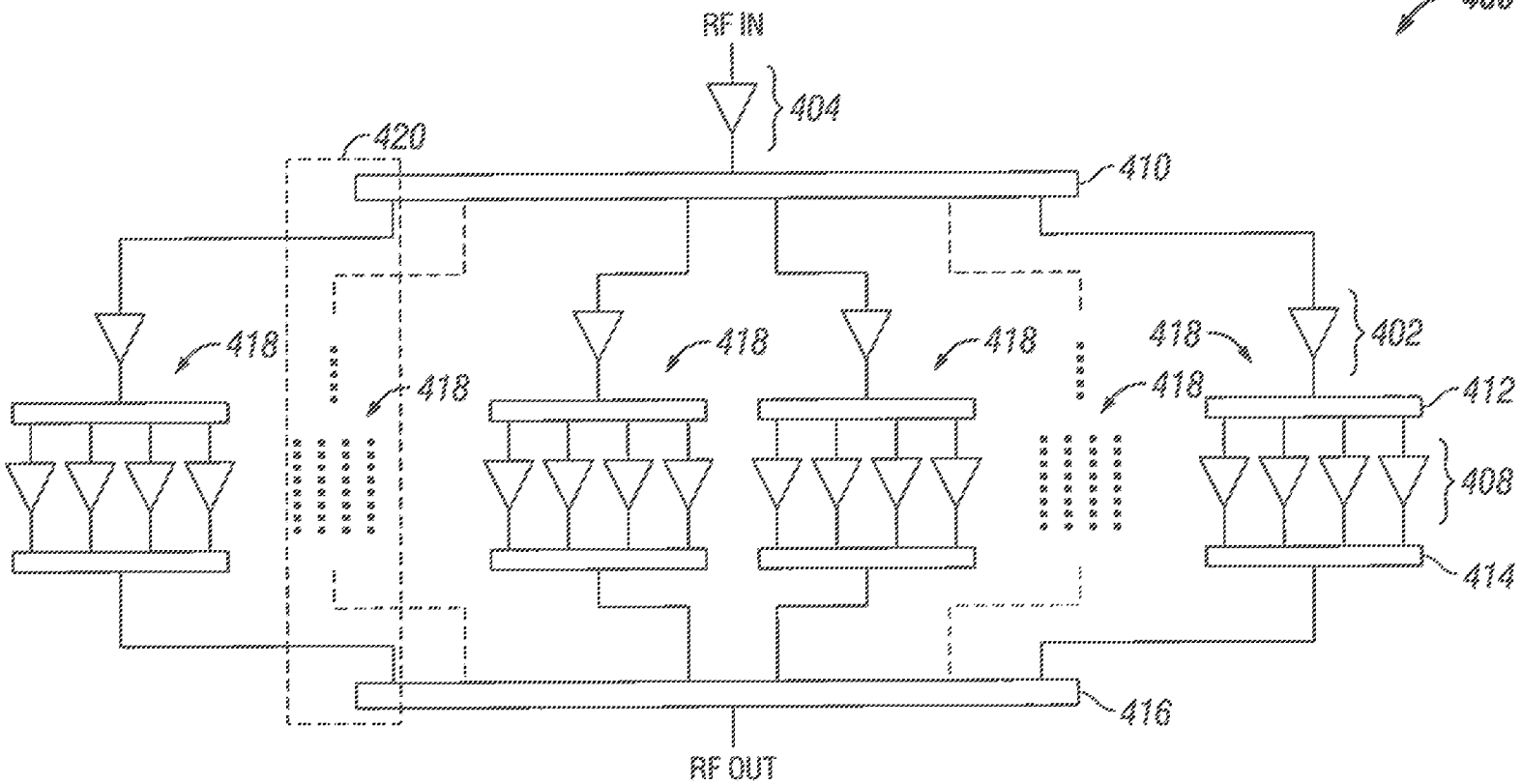
FIG. 4 shows a power amplification circuit in accordance with another embodiment of the present disclosure.

FIG. 4 shows a power amplification circuit 400 in accordance with another embodiment of the present disclosure. In FIG. 4, the power amplification circuit includes three amplifier stages (402, 404, 408), two splitting stages (410, 412), and two summing stages (414, 416). In this embodiment, each splitting stage splits the RF signal into four components and each summing stages sums four components into a single RF signal. As shown in FIG. 4 using broken lines, the power amplification circuit 400 can be expanded by including additional branches 420 of amplifiers 418 (e.g., from four branches to six branches).

In illustrative embodiments, the impedance of the power amplification circuit 108 is matched to the impedance of the accelerator waveguide 104 so that the power amplification circuit can be efficiently coupled to the accelerator waveguide mode that drives the acceleration of electrons within the accelerator waveguide.

Figure 5:
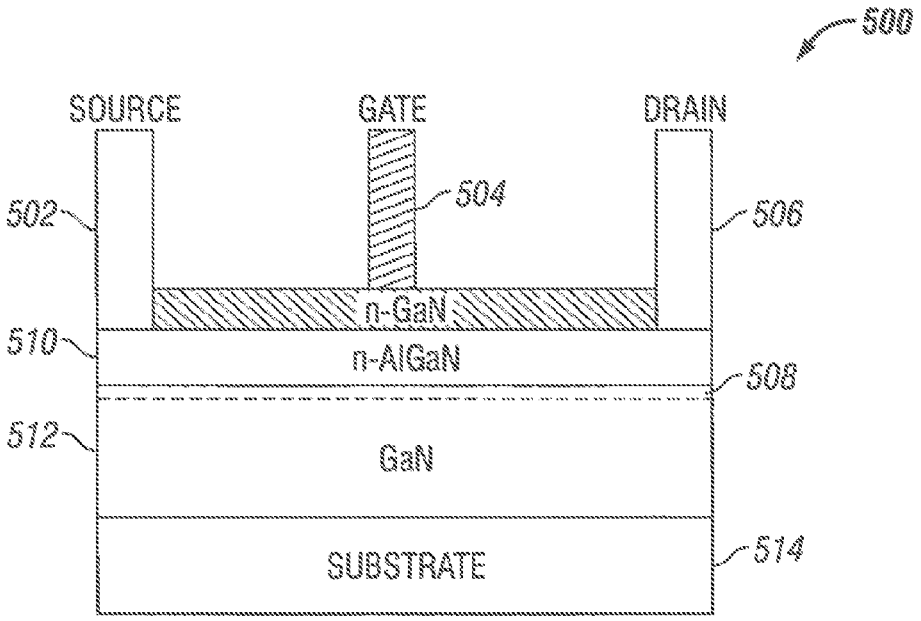
FIG. 5 shows a power amplifier in accordance with one embodiment of the present disclosure.

In illustrative embodiment of the power amplification circuit, the amplifiers are high electron mobility transistors (HEMT) that are based on a wide band gap semiconductor material, such as gallium nitride. FIG. 5 shows a power amplifier 500 in accordance with one embodiment of the present disclosure. The power amplifier is a HEMT transistor that includes a source 502, a gate 504 and a drain 506. The power amplifier 500 includes a high electron mobility two-dimensional conduction channel, which is created at an interface 508 between a first layer 510 and a second layer 512 with different band-gaps (e.g., a hetero-junction). In the embodiment shown in FIG. 5, the first layer 510 is n-type AlGaN and the second layer 512 is GaN. This arrangement generates a potential well in the conduction band of the bulk layer (e.g., the second layer 512), where electrons from the donor layer (e.g., the n-AlGaN layer 510) are trapped and can move relatively freely (e.g., high mobility and low resistivity) within the second layer. Thus, the electrons form a so-called "two-dimensional electron gas." As compared with a conventionally doped semiconductor, there are far less impurities present within the second layer 512. This lack of impurities facilitates electron transport.

The nitride layers (e.g., AlGaN and GaN) can be epitaxially grown onto a host substrate 514 with a suitable lattice constant. Substrate 514 choices include, among others, sapphire, silicon carbide, silicon and aluminum nitride. Once the nitride layers are grown on the substrate, the electrical contacts and other structures of the power amplification circuit can be fabricated using conventional semiconductor processes and techniques.

Illustrative embodiments of the present disclosure are not limited to HEMT transistors. The power amplifiers can also be a different type of hetero junction field effect transistor (e.g., a pseudo-morphic HEMT, a metamorphic HEMT, or a bipolar hetero junction transistor (HBT)). The power amplifiers can also be a metal-semiconductor transistor (MESFET) or a more conventionally doped semiconductor transistor (e.g., MISFET, MOSFET, JFET) based on a wide band gap semiconductor material.

As explained above, the power amplification circuit receives a low power input RF signal and amplifies that signal to provide a high power driving RF signal to the particle accelerator. In various embodiments, the low power input RF signal is received from an RF signal source. In some embodiment, the input RF signal source is pulsed. This pulsed waveform is then amplified by the power amplification circuit and used to power the particle accelerator in a pulsed mode of operation. In yet other embodiments, the RF signal source is continuous and the power output is modulated by modulating a gate voltage of one or more of the power amplifiers.

In one specific embodiment, the power amplification circuit outputs at least 10 kW of peak power to the particle accelerator. In some embodiments, an input RF signal of less that 1 W is provided to the power amplification circuit and the circuit provides a driving RF signal in the range of 10 KW to 100 KW. In one specific embodiment, the power amplification circuit provides a driving RF signal of at least 1 MW. In various illustrative embodiments, the power amplification circuit amplifies the initial input RF signal by at least a factor of 100. In yet another embodiment, the power amplification circuit amplifies the initial input RF signal by at least a factor of 1000. In various embodiments, the power amplification circuit operates with low voltage control and drive signals (e.g., 0-100 V). Use of such low input voltage signals is particularly advantageous in borehole applications, where high voltage power supplies are often not available. Also, in various embodiments, the ability for the power amplification circuit to operate using such low input voltage significantly increases reliability within the borehole environment. In contrast, many conventional RF amplification devices use high voltage input (e.g., greater than 10 kV).

As shown in the embodiment of FIG. 1, once the RF input signal is amplified, the signal is communicated to the particle accelerator 102 through a cable 110 (e.g., a coaxial cable) that is coupled to a waveguide port 112. In one example, a suitable coaxial cable for high temperature and high power operations includes a $SiO_2$ dielectric. In additional or alternative embodiments, the amplified RF output signal is communicated to the particle accelerator through a coupler such as a cavity, a slotted waveguide, a circular waveguide and/or a rectangular waveguide.

The X-ray generator also includes an electron source 114 that generates electrons. The electron source 114 supplies the electrons that are accelerated by the waveguide 104. In one embodiment, the electron source 114 is a heated filament (e.g., "hot cathode") that releases electrons when the filament reaches a certain temperature. In various embodiments, the heated filament is made from materials such as tungsten, barium, yttria, and $LaB_6$. In additional or alternative embodiments, the electron source 114 includes a substrate with a plurality of nano-tips disposed on the substrate (e.g., field emission array formed from nanotubes) or other field emitting arrays formed from metallic or semi-metallic tips. When an appropriate electrical field is applied to the field emitting array, the array releases electrons.

The electrons that are generated by the electron source 114 are accelerated towards a target 116 using the accelerator waveguide 104. The target 116 is configured to generate X-rays when electrons enter the target. To this end, the target 116 may include a material such as gold, platinum, tungsten or any other element with a high atomic Z number. When the electrons impact the target 116 and move through the target, at least some of the electrons generate X-rays (e.g., Bremsstrahlung). In this manner, the X-ray generator 100 generates X-rays.

The X-ray generator includes an interior volume 118 that is defined by a housing 120. The housing 120 contains the particle accelerator 102, the electron source 114, and the target 116. The interior volume 118 of the housing is in evacuated (e.g., a vacuum exists in the interior volume) so that electrons can be generated and accelerated towards the target 116 with minimum interaction with other particles.

Figure 6:
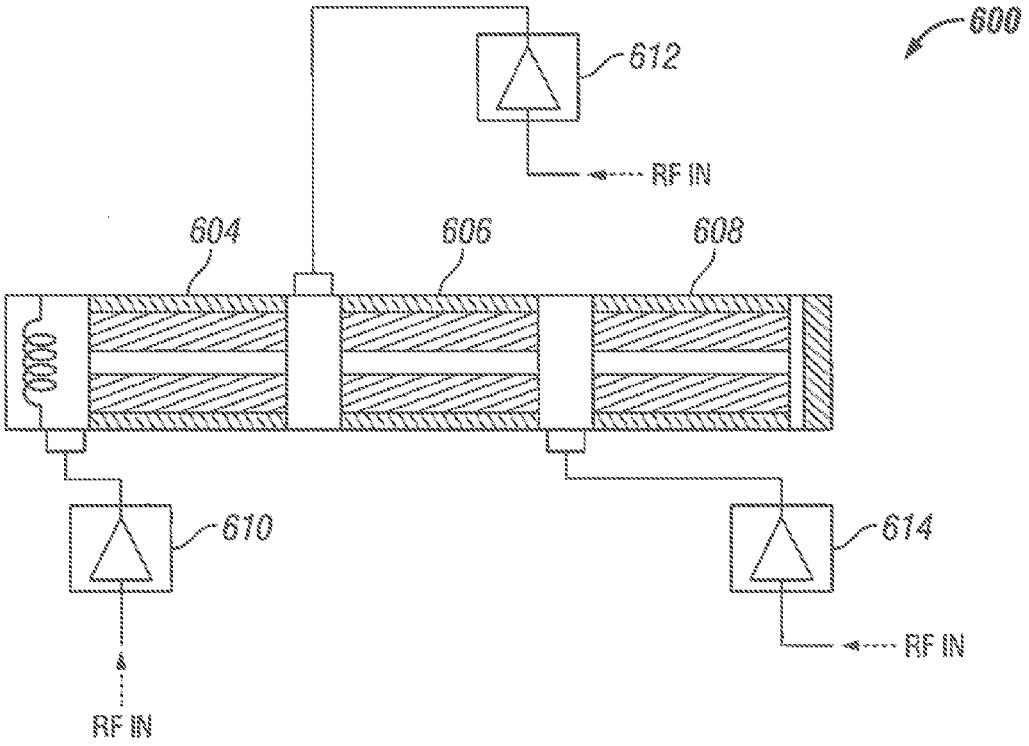
FIG. 6 shows an X-ray generator in accordance with another embodiment of the present disclosure.

FIG. 1 shows a particle accelerator 102 with a single accelerator waveguide 104. Various other embodiments of the present disclosure are directed to particle accelerators with multiple accelerator waveguides (e.g., 2, 5, 10). FIG. 6 shows an X-ray generator 600 in accordance with another embodiment of the present disclosure. The X-ray generator 600 includes a particle accelerator 602 with three accelerator waveguides 604, 606, 608. The accelerator waveguides 604, 606, 608 are connected and create a single evacuated volume (e.g., there are no foils, windows, or plates between the accelerator waveguides). In the embodiment shown in FIG. 6, each accelerator waveguide 604, 606, 608 is powered by a power amplification circuit 610, 612, 614. In illustrative embodiments, such a multiple waveguide arrangement can be advantageous because the arrangement facilitates optimization of each waveguide.

In additional or alternative embodiments, a single power amplification circuit can provide power to multiple accelerator waveguides by, for example, splitting the RF signal that is output from the single power amplification circuit. As explained above, each accelerator waveguide can range in length ($L_W$) from 2 cm to 40 cm. The particle accelerator 600 can have a total length between 2 cm and 40 cm.

Figure 7:
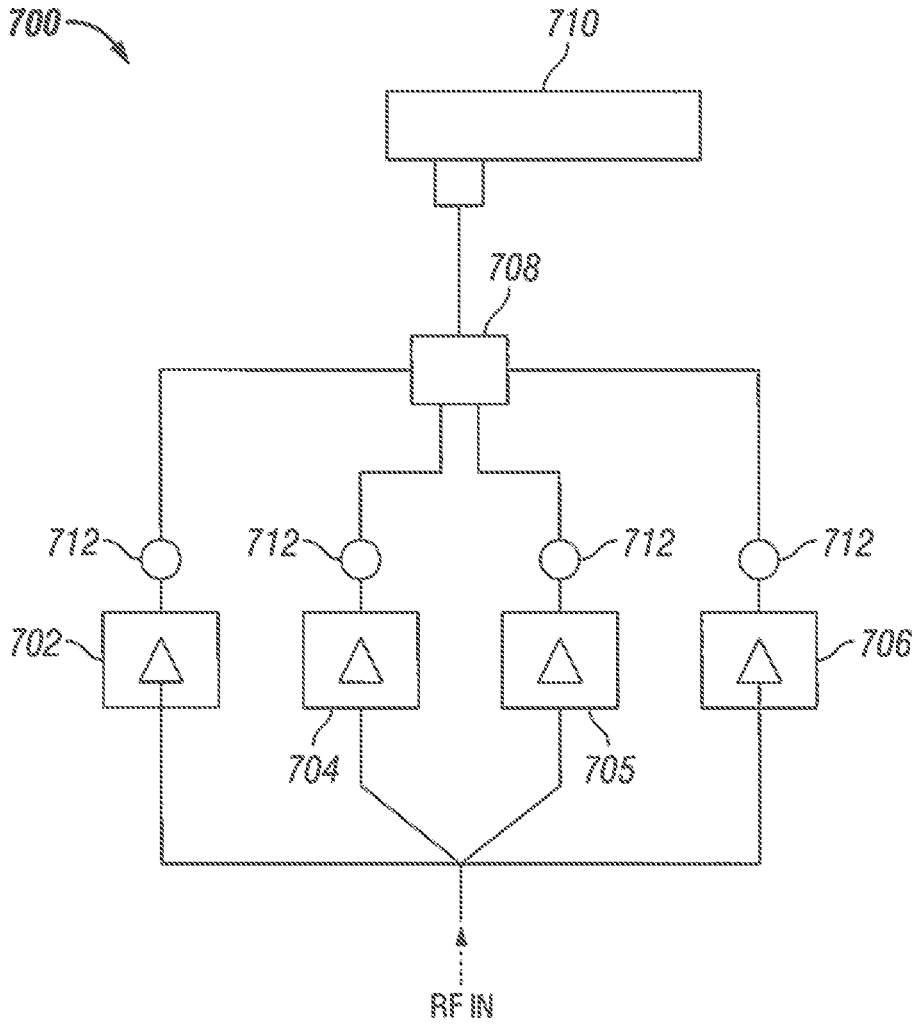
FIG. 7 shows an X-ray generator in accordance with yet another embodiment of the present disclosure.

FIG. 7 shows an X-ray generator 700 in accordance with another embodiment of the present disclosure. The X-ray 700 generator includes a plurality of power amplification circuits (e.g., 2, 3, 10) 702, 704, 705, 706. Each power amplification circuit 702, 704, 705, 706 receives an input RF signal. In the embodiment shown in FIG. 7, a single RF signal is split into four signals and provided to the power amplification circuits 702, 704, 705, 706. The amplified signal from each of the power amplification circuits 702, 704, 705, 706 is combined using a power combiner module 708 and then provided to the particle accelerator 710. In various embodiments, the power combiner module can be a waveguide or a radial RF power combiner.

Various embodiments of the X-ray generator 700 may include additional components. For example, as shown in FIG. 7, protective elements such as circulators 712 are inserted at various points in the X-ray generator 700 to protect the individual amplification circuits 702, 704, 705, 706 from large signal reflections due to undesired impedance mismatches. In various embodiments, the protective elements are fabricated as part of the power amplification circuits. In other embodiments, as shown in FIG. 7, the protective elements are separate from the power amplification circuits.

Various embodiments of the X-ray generator 700 may also include other components. For example, the X-ray generator 700 may include phase tuners (not shown) for maintaining consistent phase between each of the amplification circuits 702, 704, 705, 706. In additional or alternative embodiments, the phase tuners can also be used to maintain a consistent phase between branches of amplifiers.

Illustrative embodiments of the power amplification circuit described herein can be used to drive various different types of particle accelerators. FIGS. 1 and 7 show a linear particle accelerator (LINAC). In additional or alternative embodiments, the power amplification circuit can also be used to drive acceleration within circular accelerators, such as microtrons and cyclotrons.

In illustrative embodiments, the power amplification circuit can reliably operate in borehole applications and borehole environments. In various embodiments, the power amplification circuit can reliably operate at temperatures of at least 125° C. (e.g., 150° C., 175° C.). Furthermore, in various embodiments, the power amplification circuit operates within a microwave frequency range of 1 to 100 GHz. In further illustrative embodiments, the power amplification circuit operates at frequencies of at least 2.586 GHz (e.g., 6 GHz). In additional or alternative embodiments, the power amplification circuit operates within a microwave frequency range of at least +/−1% of a resonant frequency of an acceleration waveguide at room temperature. A broad frequency range of operation is particularly advantageous in borehole environments where temperatures are dynamic and affect the operation frequencies of the accelerator waveguide (e.g., the resonant frequency of the accelerator waveguide changes as temperature changes).

Illustrative embodiments of the power amplification circuit are fabricated as solid-state devices. As explained above, the power amplification circuit is based on a wide bandgap semiconductor material. Such solid-state power amplification circuits can have a light-weight and compact design. In this manner, various embodiments of the power amplification circuit consume less space than conventional amplifiers (e.g., klystron tubes, travelling wave tubes, and magnetrons) and facilitate use of the amplifiers within borehole tools.

In some embodiments, the solid-state power amplification circuit can be combined in modular architectures, which are easier to maintain, sustain and repair during field operations. In additional or alternative embodiments, the power amplification circuit can be made with redundant features (e.g., redundant branches of amplifiers, summing stages, splitting stages, and/or amplifier stages) so as to provide improved service life.

Those in the art recognize significant disincentives associated with using solid-state power amplifiers to drive acceleration within particle accelerators. Among other things, solid-state power amplification circuits do not support the large power requirements of many above-ground particle accelerators. Furthermore, the cost of solid-state power amplifiers is another impediment. This is particularly true for power amplifiers fabricated using gallium nitride materials. The inventor nevertheless recognized that a solid-state power amplification circuit coupled with an appropriate accelerator waveguide, as described herein, could provide sufficient power to drive the accelerator waveguide within borehole applications. Available power in borehole applications is restricted, but many borehole applications do not require high particle energies (e.g., greater than 10 MeV). In many borehole applications, final beam energies can be in a range between 100 keV to 10 MeV and overall average power budgets are below 10 kW.

Those in the art also recognize significant disincentives associated with using dielectric lined accelerators. In particular, dielectric lined accelerators are not a very powerful acceleration technology, as compared to conventional LINACs, which are more efficient in terms of energy delivered to the electron beam per unit length. The inventor recognized that a dielectric lined accelerator could provide sufficient acceleration of electrons for borehole applications (e.g., X-ray generation). In one particular embodiment, the inventor recognized that a solid-state power amplification circuit coupled with a dielectric lined accelerator could provide sufficient acceleration of electrons, while meeting the constrained spacing requirements of borehole applications.

Figure 8:
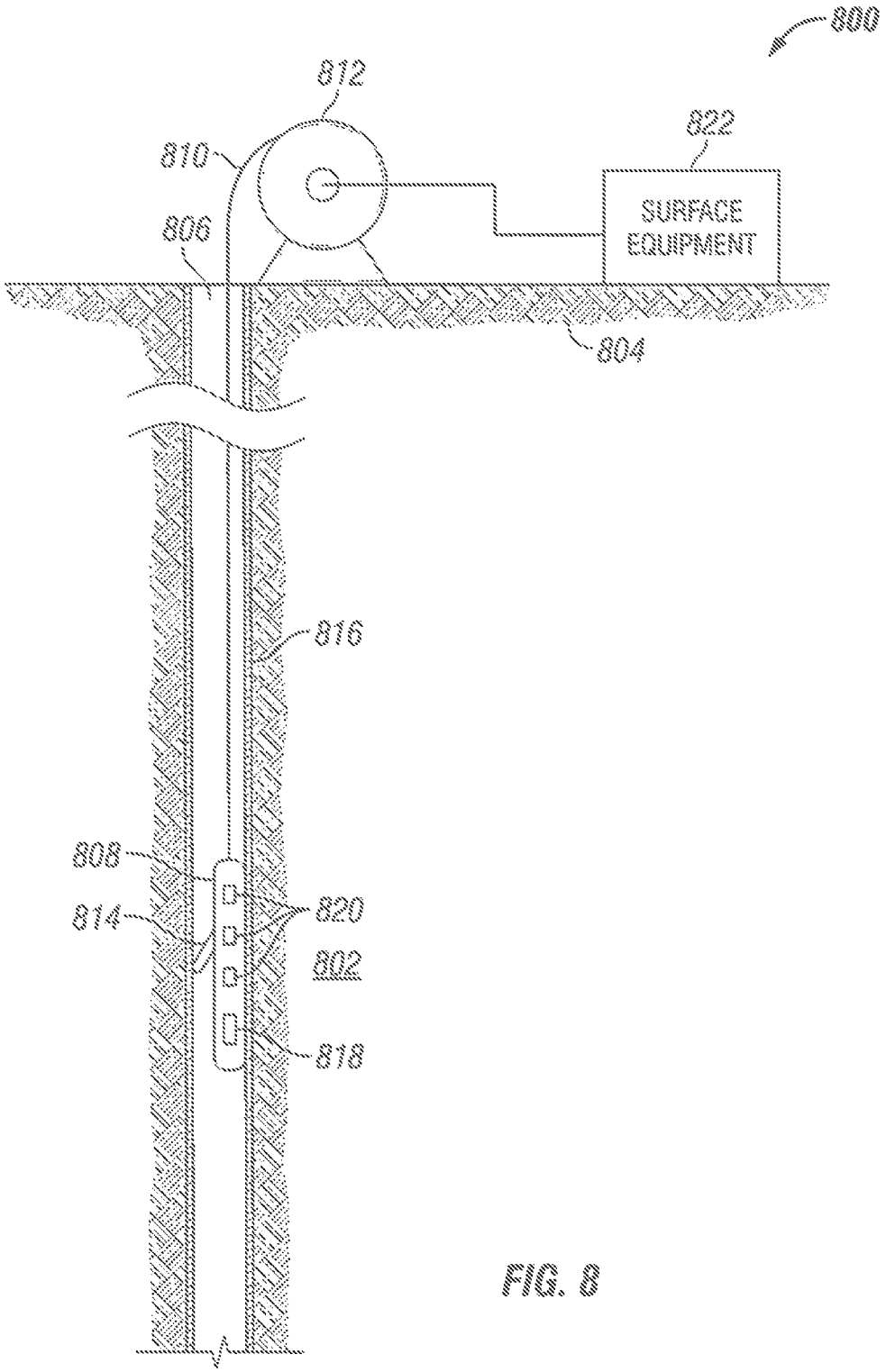
FIG. 8 shows a wireline system in accordance with one embodiment of the present disclosure.

Illustrative embodiments of the present disclosure are directed to oil field and gas field borehole applications. FIG. 8 shows a wireline system 800 for evaluating a substance 802 in accordance with one embodiment of the present disclosure. The wireline system 800 is used to investigate, in situ, a substance 802 within an earth formation 804 surrounding a borehole 806 to determine a characteristic of the substance (e.g., characteristics of solids and liquids within the formation). The borehole 806 traverses the earth formation 804. As shown in FIG. 8, a wireline tool 808 is disposed within the borehole 806 and suspended on an armored cable 810. A length of the cable 810 determines the depth of the wireline tool 808 within the borehole 806. The length of cable is controlled by a mechanism at the surface, such as a drum and winch system 812. In some embodiments, a retractable arm 814 is used to press the wireline tool 808 against a borehole wall 816.

As shown in FIG. 8, the wireline tool 808 includes an X-ray generator 818. In accordance with exemplary embodiments of the present disclosure, the X-ray generator includes a particle accelerator and a power amplification circuit, in accordance with the exemplary embodiments shown in FIGS. 1-7. The wireline tool 808 also includes at least one X-ray detector 820. The embodiment shown in FIG. 8 includes three X-ray detectors 820. The wireline system 800 includes surface equipment 822 for supporting the wireline tool 808 within the borehole 806. In various embodiments, the surface equipment 822 includes a power supply for providing electrical power to the wireline tool 800. The surface equipment 822 also includes an operator interface for communicating with the X-ray generator and the X-ray detectors. In some embodiments, the wireline tool 808 and operator interface communicate through the armored cable 810. Furthermore, although the wireline tool 808 is shown as a single body in FIG. 8, the tool may alternatively include separate bodies.

Figure 9:
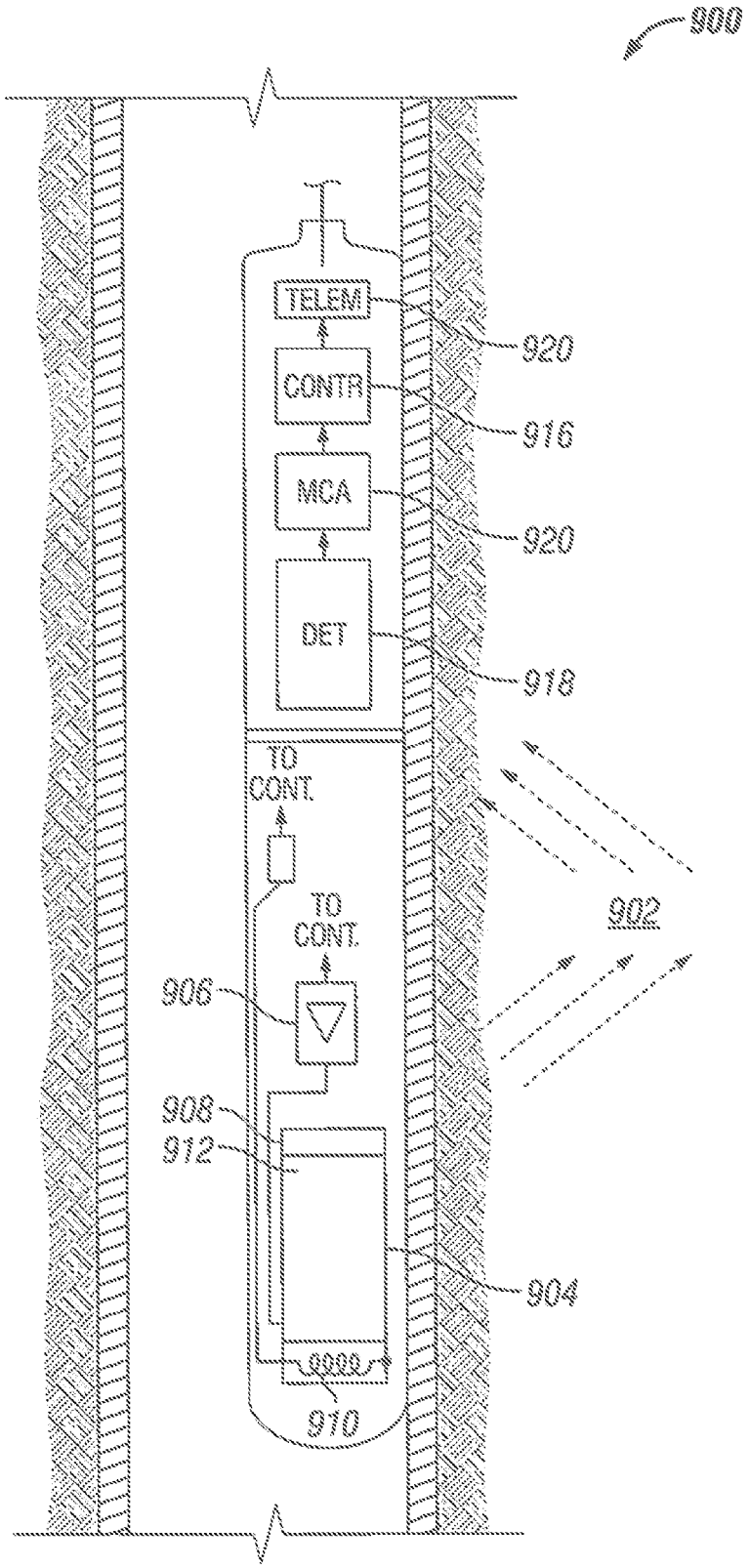
FIG. 9 shows a wireline tool in accordance with one embodiment of the present disclosure.

FIG. 9 shows a wireline tool 900 for evaluating a substance (e.g., formation 902) in accordance with one embodiment of the present disclosure. The wireline tool 900 includes an X-ray generator 904. In accordance with exemplary embodiments of the present disclosure, the X-ray generator 904 includes a power amplification circuit 906. The X-ray generator 904 also includes a target 908, an electron source 910 (e.g., filament), and a particle accelerator 912 with at least one waveguide. The particle accelerator 912 is coupled to the power amplification circuit 906. The power amplification circuit 906 and the electron source 910 are coupled to a control unit 916. As explained above, the X-ray generator 904 generates X-rays by impacting electrons against the target 908. At least some of those X-rays enter the formation 902 adjacent the wireline tool 900. The X-rays are then scattered by the formation 902.

The wireline tool 900 also includes at least one X-ray detector 918 for detecting X-rays that are scattered by the formation 902. In the exemplary embodiment shown in FIG. 9, the X-ray detector 918 uses a scintillator material to detect X-rays. When X-rays strike the scintillator material, the material produces light with intensity proportional to the energy of the X-ray. The X-ray detector also includes a photon detector (not shown) that detects the light and produces an output signal characterizing the detected X-rays (e.g., a photo multiplier tube (PMT)). The output signal is then provided to a multichannel analyzer (MCA) 920 so that the detected X-rays with different energies are counted. The counting rate and the detector X-ray energy information can be used for evaluation of the formation 902. In some embodiments, the MCA 920 may also count the detected X-rays as a function of time. The MCA 920 is electrically coupled to the control unit 916 and provides the control unit with a signal characterizing the detected X-rays.

The signal characterizing the detected X-rays and the parameters of the signal (e.g., count rate and amplitude) can be used by a computer processor to determine characteristics of the formation (e.g., density, porosity and/or photo-electric effect). In various embodiments, the surface equipment includes a computer processor programmed to interpret the signal characterizing the detected X-rays. The control unit 916 may also be coupled to a telemetry module 920 so that the wireline tool 900 can communicate with surface equipment.

In various embodiments, the wireline tool 900 includes a retractable arm that pushes a pad (not shown) against the formation 802. The X-ray generator 904 and X-ray detector 918 are disposed on the pad. Such a configuration facilities detection and measurement of the scattered X-rays. In some embodiments, the power amplification circuit 906 can be disposed within the wireline tool 900, while the X-ray generator 904 and X-ray detector 918 are disposed on the pad.

Figure 10:
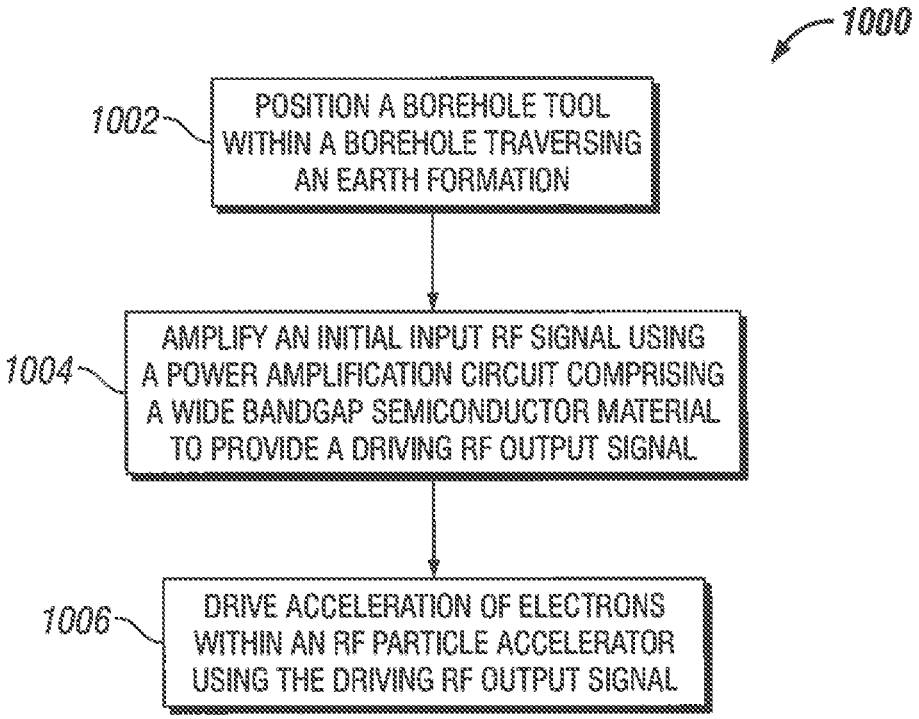
FIG. 10 shows a method for analyzing an earth formation using a borehole tool in accordance with one embodiment of the present disclosure.

Illustrative embodiments of the present disclosure are also directed to methods for analyzing earth formations using a borehole tool. FIG. 10 shows a method 1000 for analyzing an earth formation using a borehole tool in accordance with one embodiment of the present disclosure. The method includes positioning the borehole tool within a borehole that traverses the earth formation 1002. In one specific embodiment, a wireline tool is lowered down into the borehole and pressed against the formation, as shown in FIG. 8. The wireline tool includes an X-ray generator for analyzing the formation. The X-ray generator includes an RF particle accelerator and a power amplification circuit. In accordance with the embodiments described herein, the power amplification circuit is based on a wide bandgap semiconductor material, such as a combination of gallium nitride and aluminum gallium nitride. The method includes amplifying an initial input RF signal using the power amplification circuit to provide a driving RF output signal 1004. Examples of such power amplification circuits are provided in FIGS. 3, 4, 5 and 7. The driving RF output signal is used to drive acceleration of electrons within the RF particle accelerator 1006. The electrons are accelerated toward a target. When the electrons strike the target, the electrons generate X-ray radiation that enters the earth formation.

In further illustrative embodiments, X-ray radiation that scatters back from the earth formation is detected and measured using, for example, an X-ray detector located on the wireline tool. The parameters of the detected X-ray radiation (e.g., count rate and amplitude) can be used to determine characteristics of the formation, such as density, porosity, and/or photo-electric effect.

Figure 11:
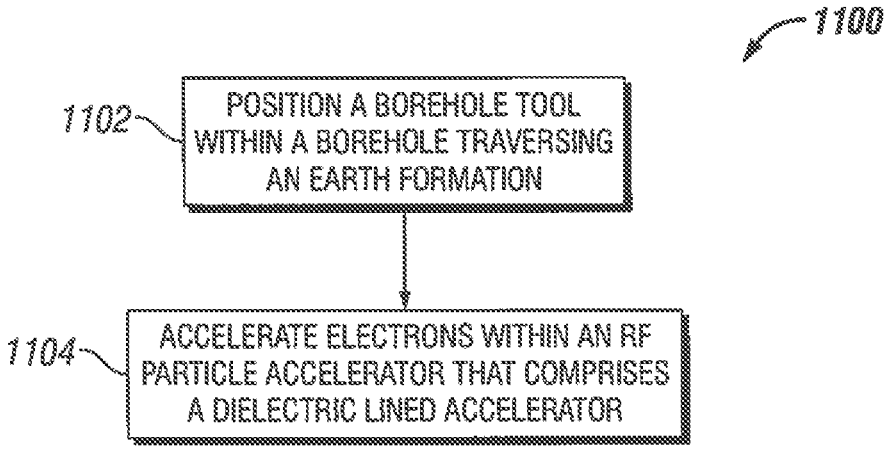
FIG. 11 shows another method for analyzing an earth formation using a borehole tool in accordance with one embodiment of the present disclosure.

Various embodiment of the present disclosure are also directed to a method for analyzing an earth formation using a borehole tool with a dielectric lined accelerator. As shown in FIG. 11, the method 1100 includes positioning the borehole tool within a borehole adjacent to the earth formation 1102. In various embodiments, an initial input RF signal is amplified using a power amplification device to provide a driving RF output signal. In some embodiments, the power amplification device is a power amplification circuit that is based on a wide bandgap semiconductor material. The driving RF output signal is used to drive acceleration of electrons within an RF particle accelerator that includes a dielectric lined accelerator 1104. Examples of such RF particle accelerators are provided in FIGS. 1, 2 and 6. The electrons are accelerated toward a target. When the electrons strike the target, the electrons generate X-ray radiation that enters the earth formation. As explained above, X-ray radiation that scatters back from the earth formation can be used to determine characteristics of the earth formation.

Illustrative embodiments of the present disclosure are not limited to wireline systems, such as the ones shown in FIGS. 8 and 9. Various embodiments of the present disclosure may also be applied in logging-while-drilling (LWD) systems (e.g., LWD tool), or any other system in a borehole tool where power amplification is performed.

Although several example embodiments have been described in detail above, those skilled in the art will readily appreciate that many modifications are possible in the example embodiments without materially departing from the scope of this disclosure. Accordingly, all such modifications are intended to be included within the scope of this disclosure.

What is claimed is:

1. A borehole tool for analyzing an earth formation, the borehole tool comprising:

an RF particle accelerator comprising a plurality of accelerator waveguides for accelerating electrons; and one or more power amplification circuits comprising a wide bandgap semiconductor material, wherein the one or more power amplification circuits amplify an initial input RF signal and provides a driving RF output signal to drive acceleration of the electrons within the plurality of accelerator waveguides in a standing wave mode, wherein the one or more power amplification circuits are configured to introduce the driving RF signal at different locations along the RF particle accelerator.

2. The borehole tool of claim 1, wherein the bandgap semiconductor material is selected from the group consisting of:

gallium nitride,
aluminum gallium nitride,
boron nitride,
diamond,
silicon carbide,
gallium oxide,
aluminum nitride, and
combinations thereof.

3. The borehole tool of claim 1, wherein the one or more power amplification circuits operate at frequencies of at least 2.856 GHz.

4. The borehole tool of claim 1, wherein the one or more power amplification circuits output at least 10 kW of peak power.

5. The borehole tool of claim 1, wherein the one or more power amplification circuits amplify the initial input RF signal by at least a factor of 100.

6. The borehole tool of claim 1, wherein the one or more power amplification circuits operate within borehole temperatures of at least 125° C.

7. The borehole tool of claim 1, wherein the one or more power amplification circuits include a plurality of high electron mobility transistors.

8. The borehole tool of claim 1, wherein the RF particle accelerator is a linear particle accelerator.

9. The borehole tool of claim 1, wherein the accelerator waveguide is a dielectric lined accelerator.

10. The borehole tool of claim 1, wherein the one or more power amplification circuits and the RF particle accelerator operate in a pulsed mode.

11. The borehole tool of claim 1, wherein the one or more power amplification circuits comprise a plurality of power amplifiers, wherein each power amplifier amplifies an input signal and outputs an amplified output signal.

12. The borehole tool of claim 11, wherein the one or more power amplification circuits comprise:

a stage of power dividers that divides the initial RF input signal and outputs the initial RF input to each power amplifier; and a stage of power combiners generates the driving RF output signal by combining the amplified output signal of each power amplifier.

13. The borehole tool of claim 1, further comprising:

a X-ray generator that incorporates the RF particle accelerator and the one or more power amplification circuits, wherein the X-ray generator further comprises:

a target for generating X-rays; and an electron source for generating electrons.

14. The borehole tool of claim 1, wherein the borehole tool is a wireline tool.

15. The borehole tool of claim 1, wherein the borehole tool is a logging-while-drilling tool.

16. A method comprising:

positioning a borehole tool within a borehole traversing an earth formation;

amplifying an initial input RF signal using one or more power amplification circuits comprising a wide bandgap semiconductor material to provide a driving RF output signal; and driving acceleration of electrons within an RF particle accelerator using the driving RF output signal in a standing wave mode, wherein the driving RF signal is introduced at different locations along the RF particle accelerator.

17. The method of claim 16, further comprising:

accelerating the electrons toward a target to generate X-ray radiation that enters the earth formation;

detecting X-ray radiation that scatters back from the earth formation; and determining a characteristic of the earth formation using the detected X-ray radiation.

18. The method of claim 16, wherein the one or more power amplification circuits operate at frequencies of at least 2.856 GHz.

19. The method of claim 16, wherein the one or more power amplification circuits include a plurality of high electron mobility transistors.

20. The method of claim 16, wherein the one or more power amplification circuits amplify the initial input RF signal by at least a factor of 100.

* * * * *